US007370497B2

(12) United States Patent
Yu

(10) Patent No.: US 7,370,497 B2
(45) **Date of Patent: *May 13, 2008**

(54) MULTIFUNCTIONAL PADLOCK HAVING SHACKLE LIMIT KNOB

(76) Inventor: Chun Te Yu, No. 253, Sec. 3, Yanhai Rd., Fusing Township, Changhua County 506 (TW)

( * ) Notice: Subject to any disclaimer, the term of this patent is extended or adjusted under 35 U.S.C. 154(b) by 0 days.

This patent is subject to a terminal disclaimer.

(21) Appl. No.: 11/474,936

(22) Filed: Jun. 27, 2006

(65) Prior Publication Data

US 2006/0236731 A1 Oct. 26, 2006

Related U.S. Application Data

(63) Continuation-in-part of application No. 11/032,116, filed on Jan. 11, 2005, now Pat. No. 7,100,401, and a continuation-in-part of application No. 11/272,709, filed on Nov. 15, 2005.

(30) Foreign Application Priority Data

Aug. 22, 2005 (TW) ..... 94128645 A
May 26, 2006 (TW) ..... 95118920 A

(51) Int. Cl.
*E05B 37/02* (2006.01)

(52) U.S. Cl. ..... 70/21; 70/25; 70/284; 70/285; 70/432

(58) Field of Classification Search ..... 70/21, 70/25, 26, 284, 285, 432, 435, 437, 441, 70/DIG. 63, DIG. 71, 38 R, 38 A, 38 B, 70/38 C See application file for complete search history.

(56) References Cited

U.S. PATENT DOCUMENTS 1,597,560 A * 8/1926 Wise ..... 70/38 R
1,622,999 A * 3/1927 Frith ..... 70/38 A
2,457,650 A * 12/1948 Dyson ..... 70/38 A
2,487,608 A * 11/1949 Soref et al. ..... 70/21
3,143,872 A * 8/1964 Check ..... 70/38 A
4,462,231 A * 7/1984 Zabel ..... 70/21
4,751,830 A * 6/1988 Cheng ..... 70/25
6,539,761 B2 * 4/2003 Yang ..... 70/284

(Continued)

*Primary Examiner*—Lloyd A. Gall
(74) *Attorney, Agent, or Firm*—Rosenberg, Klein & Lee

(57) ABSTRACT

A padlock includes a housing, a shackle, a limit knob, a movable member and a first locking mechanism. The shackle is movably mounted on the housing and has a root section extended into the housing and a free section having a first end extended from the root section and a second end extended outside of the housing. The limit knob is movably mounted on the housing to control movement of the free section of the shackle. The movable member is movably mounted in the limit knob. Additionally, the first locking mechanism is mounted in the housing to control movement of the limit knob and the movable member.

16 Claims, 7 Drawing Sheets

U.S. PATENT DOCUMENTS

| | | | | |
|---|---|---|---|---|
| 6,848,283 | B1 | 2/2005 | Lin | |
| 6,860,125 | B1 | 3/2005 | Yu et al. | |
| 6,877,345 | B1 | 4/2005 | Misner et al. | |
| 7,007,521 | B1 | 3/2006 | Misner et al. | |
| 7,047,773 | B1 * | 5/2006 | Lin | 70/25 |
| 7,100,401 | B2 * | 9/2006 | Yu | 70/21 |
| 7,131,299 | B1 * | 11/2006 | Huang | 70/21 |
| 7,140,209 | B2 * | 11/2006 | Lai | 70/25 |
| 7,155,943 | B1 * | 1/2007 | Lin | 70/21 |
| 7,155,944 | B1 * | 1/2007 | Lin | 70/21 |
| 7,159,422 | B1 * | 1/2007 | Misner et al. | 70/21 |
| 7,201,026 | B2 * | 4/2007 | Yu | 70/21 |
| 7,204,108 | B2 * | 4/2007 | Yu | 70/21 |
| 2002/0088256 | A1 | 7/2002 | Taylor et al. | |
| 2004/0226323 | A1 | 11/2004 | Ling et al. | |
| 2004/0226324 | A1 | 11/2004 | Loughlin et al. | |
| 2005/0034492 | A1 | 2/2005 | Yu | |
| 2005/0039500 | A1 | 2/2005 | Yu | |
| 2005/0039501 | A1 | 2/2005 | Yu | |
| 2005/0092036 | A1 * | 5/2005 | Lai | 70/25 |
| 2005/0262902 | A1 | 12/2005 | Ling et al. | |
| 2005/0262903 | A1 * | 12/2005 | Ling et al. | 70/21 |
| 2006/0032274 | A1 * | 2/2006 | Yu | 70/25 |
| 2006/0107709 | A1 * | 5/2006 | Yu | 70/21 |
| 2006/0107710 | A1 * | 5/2006 | Yu | 70/25 |
| 2006/0254325 | A1 * | 11/2006 | Yu | 70/21 |
| 2006/0254329 | A1 * | 11/2006 | Yu | 70/284 |
| 2006/0266084 | A1 | 11/2006 | Kuo et al. | |

* cited by examiner

MULTIFUNCTIONAL PADLOCK HAVING SHACKLE LIMIT KNOB

CROSS REFERENCE TO RELATED APPLICATION

This is a continuation-in-part application of 11/032,116 U.S. Pat. No. 7,100,401, filed on Jan. 11, 2005, and also a continuation-in-part application of the co-pending U.S. Ser. No. 11/272,709 application, filed on Nov. 15, 2005.

BACKGROUND OF THE INVENTION

1. Field of the Invention

The present invention relates to a padlock, and more particularly to a multifunctional padlock having an outwardly exposed shackle limit knob.

2. Description of the Related Art

A conventional padlock disclosed in U.S. Pat. No. 6,860,125 and U.S. Publication No. 2005/0034492 comprises a locking mechanism, a shackle, and a shackle limit knob. The shackle limit knob is controlled by the locking mechanism to lock or release the free end of the shackle.

Another conventional padlock disclosed in the U.S. Pat. No. 6,848,283 and the U.S. Publication Nos. 2002/0088256, 2004/0226323, 2004/0226324 and 2005/0039500 has a double lock function to facilitate the inspector of the customs checking the luggage.

Another conventional padlock disclosed in the U.S. Pat. Nos. 6,877,345 and 7,007,521 has a double lock function and has an indicator to remind if the padlock has been opened by a key. Such a padlock does not have a shackle limit knob.

Another conventional padlock disclosed in the U.S. Publication No. 2005/0262902 has a double lock function and has an indicator and a shackle to remind if the padlock has been opened by a key. The indicator cannot indicate if the padlock has been opened by an insert instead of a key.

SUMMARY OF THE INVENTION

The present invention is to mitigate and/or obviate the disadvantage of the conventional padlock.

The primary objective of the present invention is to provide a padlock, wherein when the key or an insert is inserted into the key hole, the extension of the movable member is detached from the peep hole of the limit knob to remind the user that the first locking mechanism has been operated and opened by an external force, so that the user can open the luggage by unlocking the padlock to check if the items contained in the luggage are missed.

Another objective of the present invention is to provide a padlock, wherein the extension of the movable member functions as an indicator that is directly mounted on the limit knob without occupy the inner space of the housing, so that the padlock has a smaller volume.

A further objective of the present invention is to provide a padlock, wherein the indicator is directly mounted on the limit knob, so that the padlock has an excellent reminding effect.

In accordance with the present invention, there is provided a padlock, comprising:

a housing;

a shackle movably mounted on the housing and having a root section extended into the housing and a free section having a first end extended from the root section and a second end extended outside of the housing;

a limit knob movably mounted on the housing to control movement of the free section of the shackle;

a movable member movably mounted in the limit knob;

a first locking mechanism mounted in the housing to control movement of the limit knob and the movable member.

Further benefits and advantages of the present invention will become apparent after a careful reading of the detailed description with appropriate reference to the accompanying drawings.

DETAILED DESCRIPTION OF THE INVENTION

Figure 2:
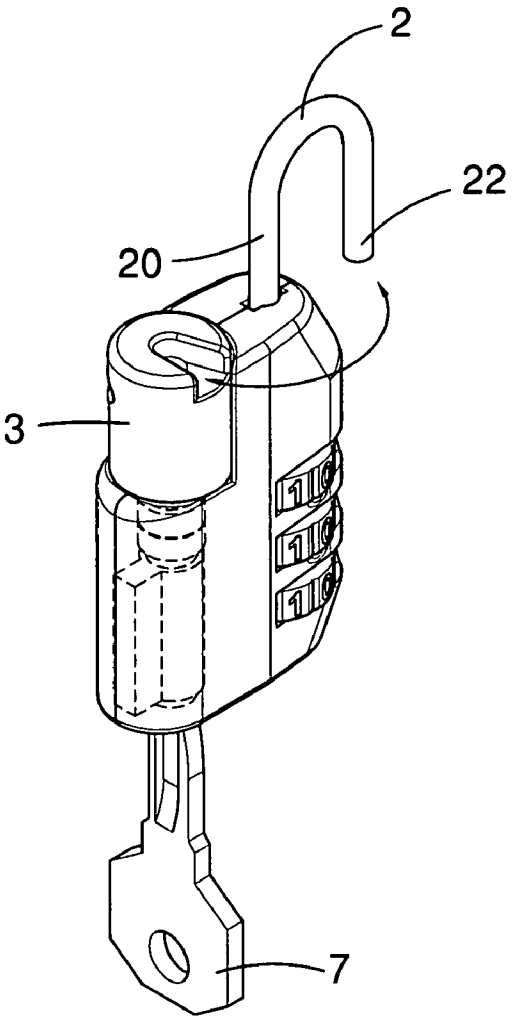
FIG. 2 is a schematic operational view of the padlock as shown in FIG. 1.

Referring to the drawings and initially to FIGS. 1-9, a padlock for a luggage in accordance with the preferred embodiment of the present invention comprises a housing 1, a shackle 2, a limit knob 3, a movable member 4, a first locking mechanism 5, and a second locking mechanism 6.

The housing 1 consists of two shells 10 and 11. The shackle 2 includes a root section 20 extended into the housing 1 to form a movable connection with the housing 1, and a free section 22 having a first end extended from the root section 20 and a second end extended into the limit knob 3. The limit knob 3 is movably mounted on the housing 1 to control movement of the free section 22 of the shackle 2.

The movable member 4 is movably mounted in the limit knob 3 and movable relative to the limit knob 3 between a first position and a second position. The first locking mechanism 5 is mounted in the housing 1 to control movement of the limit knob 3 and the movable member 4. The first locking mechanism 5 directly controls the limit knob 3 and the movable member 4 by a special structure to change their positions.

In the preferred embodiment of the present invention, the first locking mechanism 5 includes a key lock unit 50 and a movable shaft 51 mounted on the key lock unit 50. The key lock unit 50 directly controls movement of the limit knob 3 and has a key hole 500 to receive a matching key 7. When the key 7 or an insert (not shown) is inserted into the key hole 500 of the key lock unit 50, the movable shaft 51 is driven to move the movable member 4 between the first position and the second position. Thus, the first locking mechanism 5 directly controls movement of the limit knob 3 and the movable member 4 by the key lock unit 50 and the movable shaft 51 respectively.

The key lock unit 50 includes a lock core 501 secured in the housing 1, and a mandrel 502 extended through the lock core 501 and driven and rotated by the key 7. The mandrel 502 has one end formed with a control portion 503 engaging a base portion 32 of the limit knob 3. In the preferred embodiment of the present invention, the control portion 503 of the mandrel 502 has an upper end formed with a square recess 504, and the base portion 32 of the limit knob 3 has a lower end formed with a square plug 321 inserted into the square recess 504 of the mandrel 502, so that the limit knob 3 is driven and rotated by the key lock unit 50 of the first locking mechanism 5.

The second locking mechanism 6 is mounted on the housing 1 to control upward and downward movement of the root section 20 of the shackle 2. The second locking mechanism 6 includes a number lock module 60 which is connected with the root section 20 of the shackle 2 and arranged to allow rotation of the root section 20 of the shackle 2.

Figure 1:
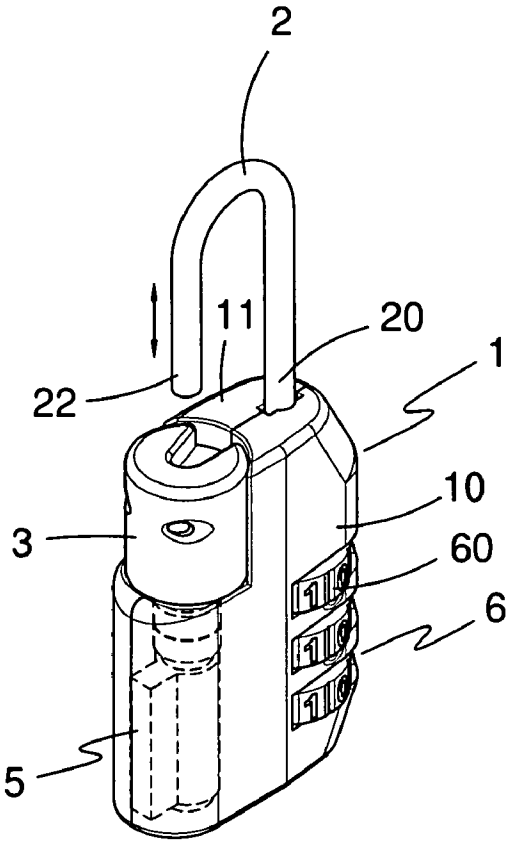
FIG. 1 is a perspective view of a padlock in accordance with the preferred embodiment of the present invention.

Thus, as shown in FIG. 1, when the number lock module 60 is disposed at an unlocked state (when the code is correct), the root section 20 of the shackle 2 is released, and the number lock module 60 allows the shackle 2 to move with displacement of the root section 20 to detach the free section 22 of the shackle 2 from the limit knob 3.

Alternatively, as shown in FIG. 2, when the number lock module 60 is disposed at a locked state (when the code is incorrect), the root section 20 of the shackle 2 is locked. At this time, when the limit knob 3 is driven and rotated by the key lock unit 50 of the first locking mechanism 5 to expose the free section 22 of the shackle 2 from the housing 1, the free section 22 of the shackle 2 is rotated about the root section 20 of the shackle 2 to detach from the limit knob 3.

Figure 3:
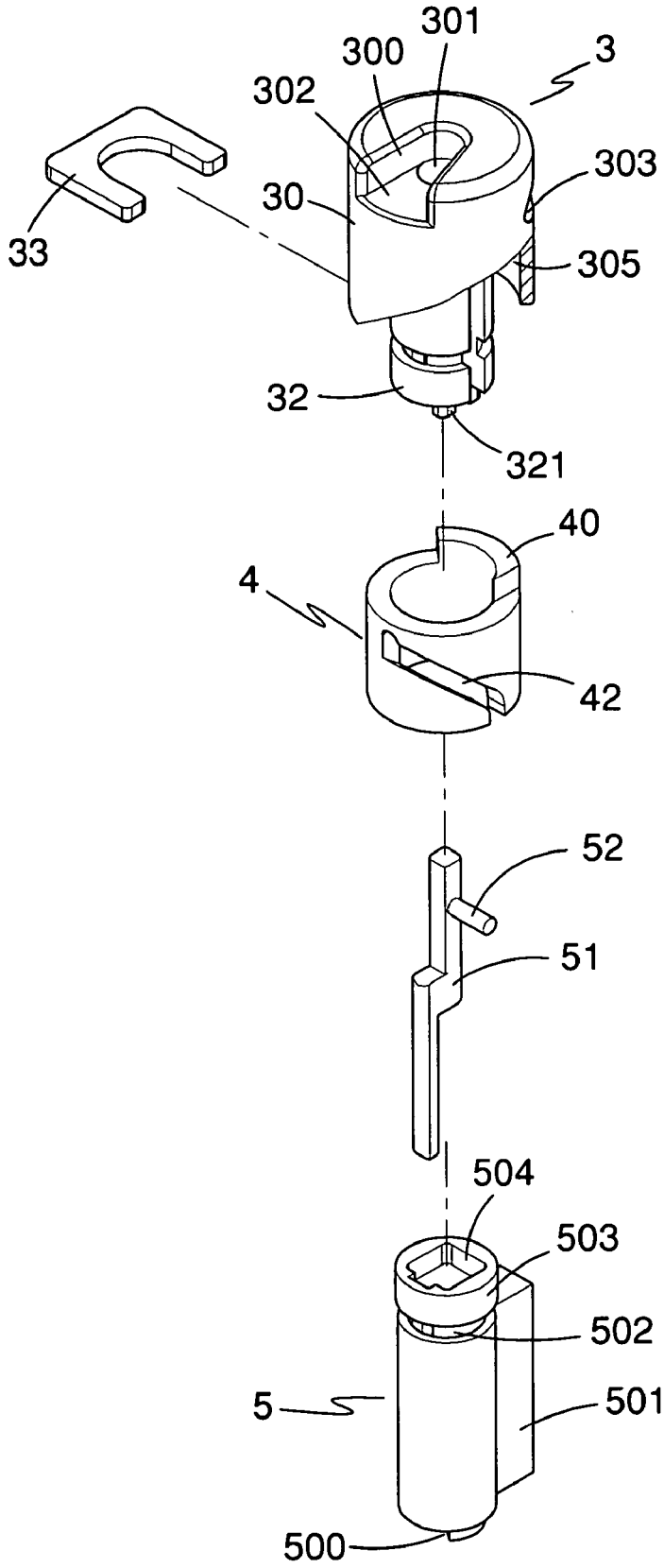
FIG. 3 is a partially exploded perspective view of the padlock as shown in FIG. 1.

As shown in FIG. 3, the limit knob 3 includes a knob body 30 rotatably mounted on the housing 1, and a limit plate 33 secured in the housing 1 and connected with the knob body 30 to limit the knob body 30 in the housing 1. The knob body 30 of the limit knob 3 has an outer portion formed with a receiving recess 300 to receive the free section 22 of the shackle 2 and an inner portion formed with a receiving chamber 305 to receive the movable member 4. The base portion 32 of the limit knob 3 is extended from the knob body 30 into the housing 1. The receiving recess 300 has a central portion formed with a first opening 301 and a peripheral wall formed with a second opening 302 connected to the first opening 301, and the free section 22 of the shackle 2 is moved vertically in the first opening 301 and is detached from the limit knob 3 through the second opening 302.

The knob body 30 of the limit knob 3 has a side wall formed with a peep hole 303. The movable member 4 has an extension 40 which is exposed from the peep hole 303 of the limit knob 3 when the movable member 4 is movable to the first position and is detached from the peep hole 303 of the limit knob 3 when the movable member 4 is movable to the second position. In addition, when the key 7 or an insert is inserted into the key hole 500 of the key lock unit 50, the movable shaft 51 is driven to move the movable member 4 between the first position where the extension 40 of the movable member 4 is exposed from the peep hole 303 of the limit knob 3 and the second position where the extension 40 of the movable member 4 is detached from the peep hole 303 of the limit knob 3. Thus, when the key 7 or an insert is inserted into the key hole 500 of the key lock unit 50, the extension 40 of the movable member 4 is exposed from the peep hole 303 of the limit knob 3, which indicates that the first locking mechanism 5 has been operated and opened by an external force.

Figure 5:
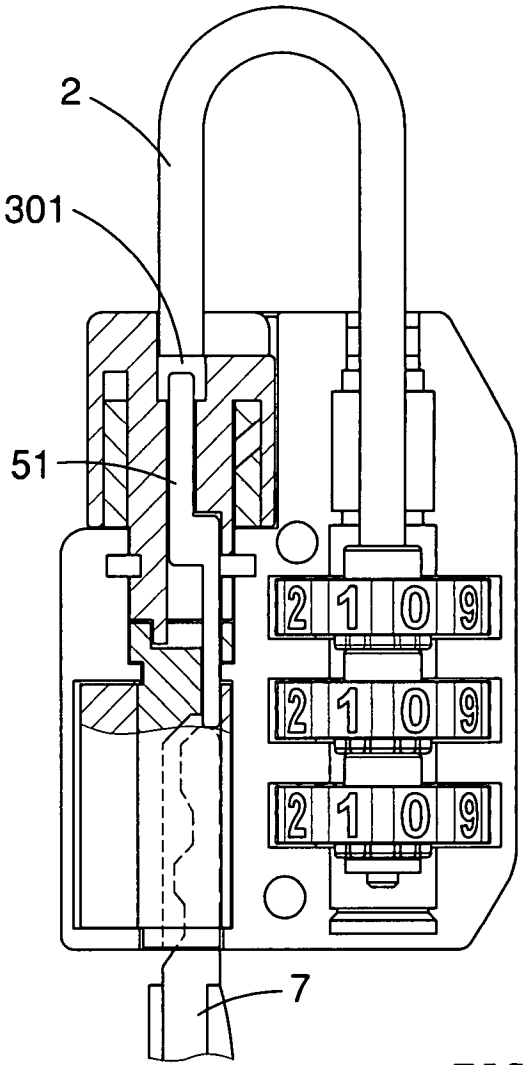
FIG. 5 is a schematic operational view of the padlock as shown in FIG. 4.
Figure 4:
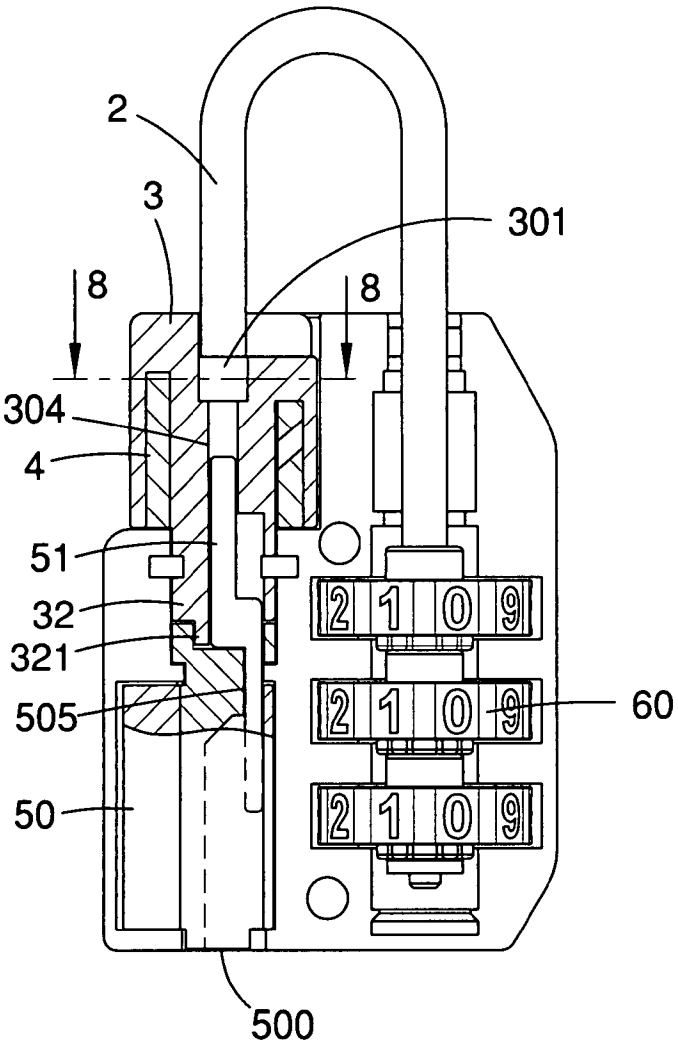
FIG. 4 is a plan cross-sectional view of the padlock as shown in FIG. 1.

As shown in FIG. 4, the limit knob 3 has an inside formed with a through hole 304 extended through the knob body 30 and the base portion 32 of the limit knob 3 and connected to the first opening 301 of the limit knob 3 and the square recess 504 of the mandrel 502 of the key lock unit 50. The movable shaft 51 of the first locking mechanism 5 is partially movable in the through hole 304 of the limit knob 3. The mandrel 502 of the key lock unit 50 of the first locking mechanism 5 has an inner portion formed with a through bore 505 connected to the, square recess 504 of the mandrel 502 and the key hole 500 of the key lock unit 50. Thus, the movable shaft 51 of the first locking mechanism 5 is movable in a passage defined between the key hole 500, the through bore 505, the square recess 504, the through hole 304 and the first opening 301. In addition, when the key 7 or an insert is inserted into the key hole 500 of the key lock unit 50, the movable shaft 51 of the first locking mechanism 5 is moved upward to a determined position where the upper end of the movable shaft 51 is exposed from the first opening 301 of the limit knob 3 as shown in FIG. 5.

Figure 6:
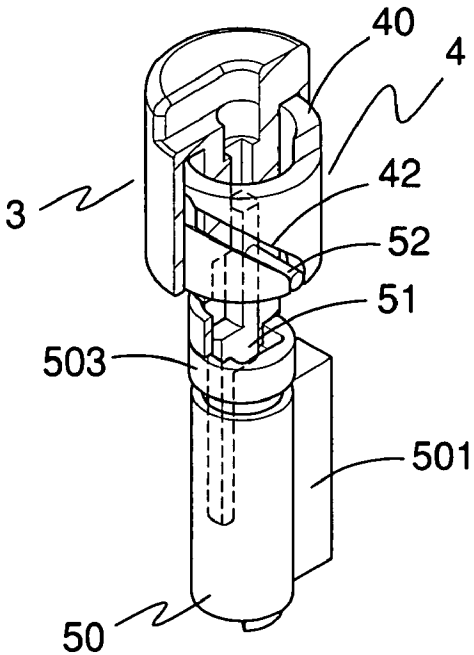
FIG. 6 is a perspective assembly view as shown in FIG. 3.

As shown in FIG. 6, the movable shaft 51 is partially extended into the movable member 4. The movable member 4 has a side wall formed with a helical guide groove 42, and the movable shaft 51 is provided with a guide rod 52 movably mounted in the guide groove 42 of the movable member 4. Thus, when the movable shaft 51 of the first locking mechanism 5 is moved upward to the determined position as shown in FIG. 5 where the upper end of the movable shaft 51 is exposed from the first opening 301 of the limit knob 3, the guide rod 52 of the movable shaft 51 is lifted in the guide groove 42 of the movable member 4 to drive the movable member 4 to rotate relative to the limit knob 3. Thus, when the key 7 or an insert is inserted into the key hole 500 of the key lock unit 50 as shown in FIG. 7, the movable shaft 51 of the first locking mechanism 5 is moved upward to the determined position as shown in FIG. 5, and the movable member 4 is driven to rotate relative to the limit knob 3.

Figure 7:
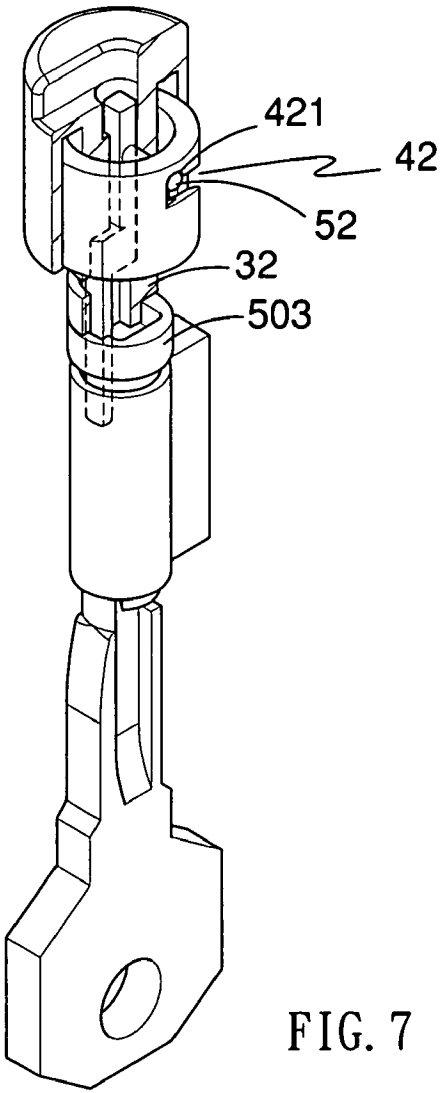
FIG. 7 is a schematic operational view as shown in FIG. 6.

As shown in FIG. 7, the guide groove 42 of the movable member 4 has a top end formed with a positioning cavity 421 to position the guide rod 52 of the movable shaft 51 when the guide rod 52 of the movable shaft 51 is lifted to the top end of the guide groove 42 of the movable member 4 to prevent the movable shaft 51 from being moved freely due to the gravity or an external force.

Figure 9:
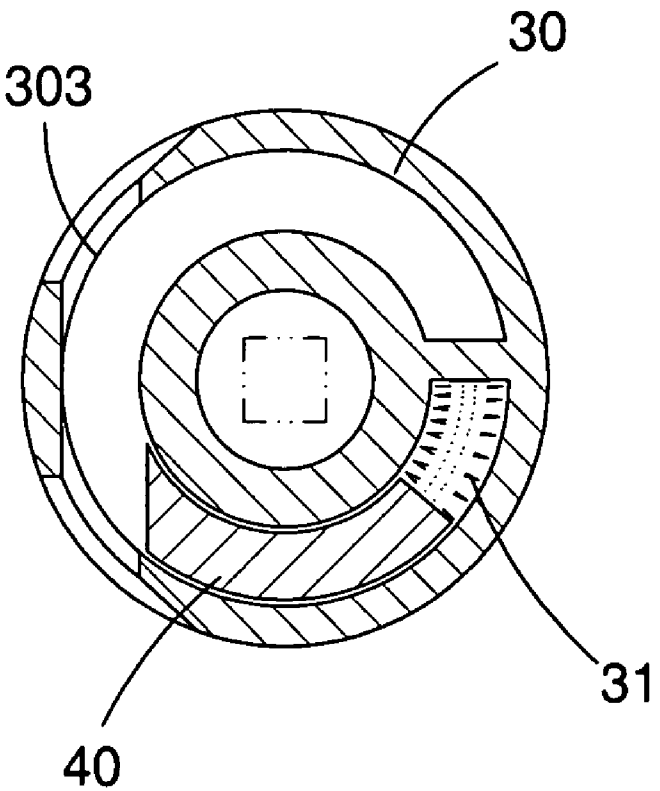
FIG. 9 is a schematic operational view as shown in FIG. 8.
Figure 8:
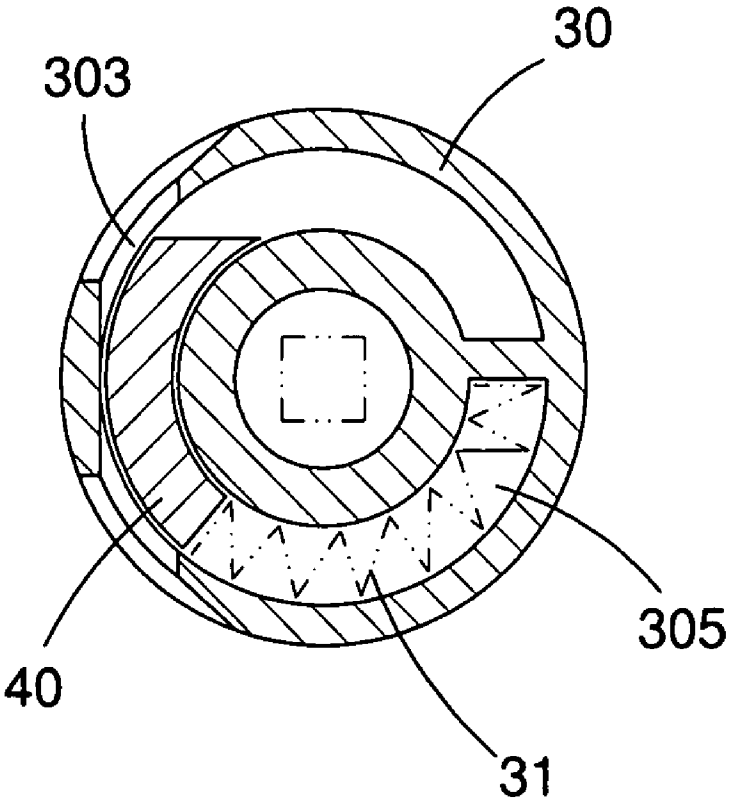
FIG. 8 is a plan cross-sectional view taken along line 8-8 as shown in FIG. 4.

As shown in FIG. 8, the limit knob 3 further includes an elastic member 31 mounted in the receiving chamber 305 of the knob body 30 and biased between the knob body 30 and the extension 40 of the movable member 4. When the movable member 4 is movable from the first position as shown in FIG. 8 where the extension 40 of the movable member 4 is exposed from the peep hole 303 of the limit knob 3 to the second position as shown in FIG. 9 where the extension 40 of the movable member 4 is detached from the peep hole 303 of the limit knob 3, the guide rod 52 of the movable shaft 51 is positioned in the positioning cavity 421 of the guide groove 42 of the movable member 4 as shown in FIG. 7, and the elastic member 31 is pressed by the extension 40 of the movable member 4 as shown in FIG. 9. At this time, the extension 40 of the movable member 4 is detached from the peep hole 303 of the limit knob 3 to remind the user that the first locking mechanism 5 has been operated and opened by an external force, so that the user can open the luggage by unlocking the padlock to check if the items contained in the luggage are missed.

On the contrary, after the number lock module 60 is disposed at an unlocked state (when the code is correct), the shackle 2 is movable relative to the limit knob 3 to extend the free section 22 of the shackle 2 into the first opening 301 of the limit knob 3 to push the movable shaft 51 downward and to drive the movable member 4 to rotate in the opposite direction, thereby detaching the guide rod 52 of the movable shaft 51 from the positioning cavity 421 of the guide groove 42 of the movable member 4, and thereby releasing the elastic member 31, so that the extension 40 of the movable member 4 is pushed by the restoring force of the elastic member 31 to drive the movable member 4 to move relative to the limit knob 3 in the opposite direction until the movable member 4 is returned to the first position as shown in FIG. 8 where the extension 40 of the movable member 4 is exposed from the peep hole 303 of the limit knob 3. At this time, the guide rod 52 of the movable shaft 51 is moved downward in the guide groove 42 of the movable member 4 during rotation of the movable member 4 to push the movable shaft 51 downward to return the movable shaft 51 to the original state as shown in FIGS. 4 and 6. Thus, the extension 40 of the movable member 4 is exposed from the peep hole 303 of the limit knob 3 after the number lock module 60 is disposed at an unlocked state (when the code is correct).

Accordingly, when the key 7 or an insert is inserted into the key hole 500, the extension 40 of the movable member 4 is detached from the peep hole 303 of the limit knob 3 to remind the user that the first locking mechanism 5 has been operated and opened by an external force, so that the user can open the luggage by unlocking the padlock to check if the items contained in the luggage are missed. In addition, the extension 40 of the movable member 4 functions as an indicator that is directly mounted on the limit knob 3 without occupy the inner space of the housing 1, so that the padlock has a smaller volume. Further, the indicator is directly mounted on the limit knob 3, so that the padlock has an excellent reminding effect.

Figure 10:
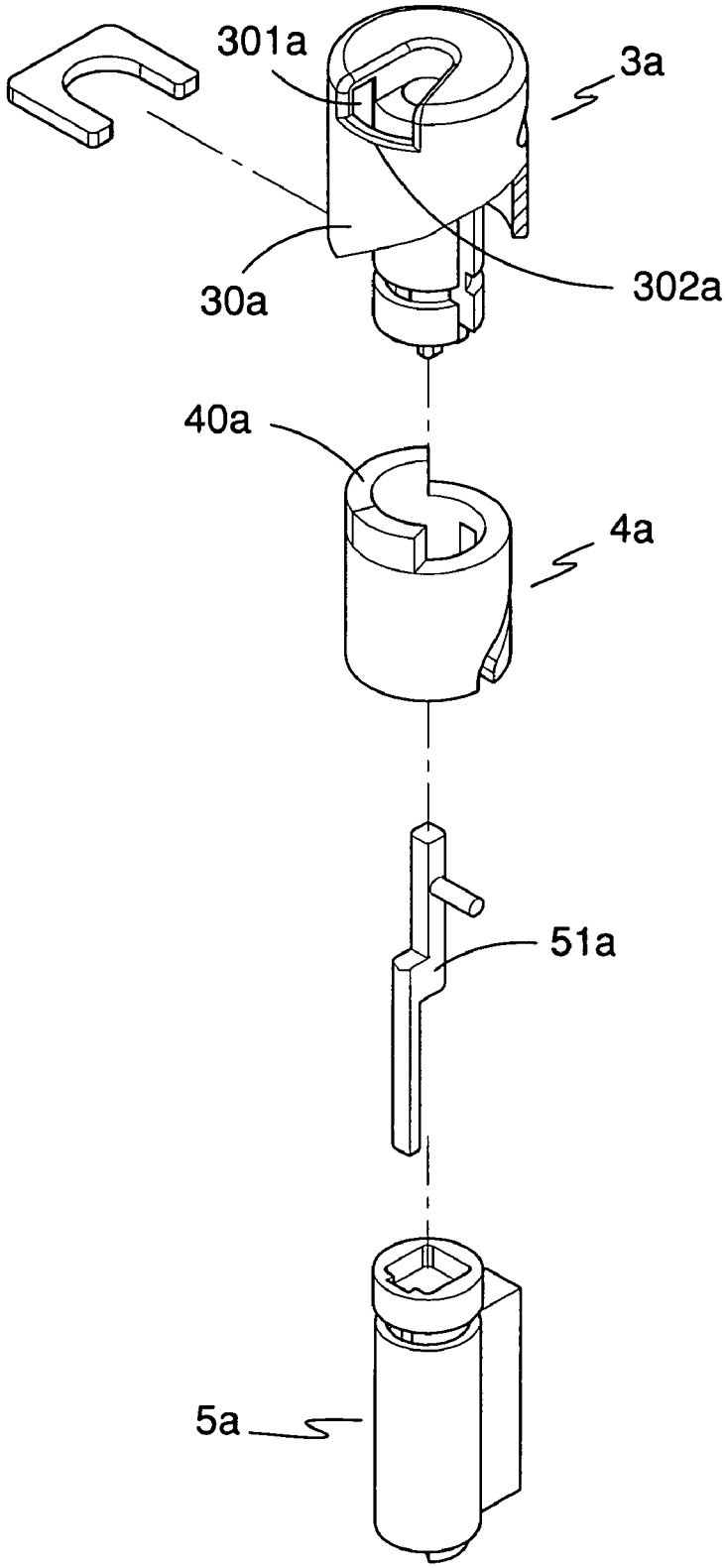
FIG. 10 is a partially exploded perspective view of another preferred embodiment of the present invention.
Figure 12:
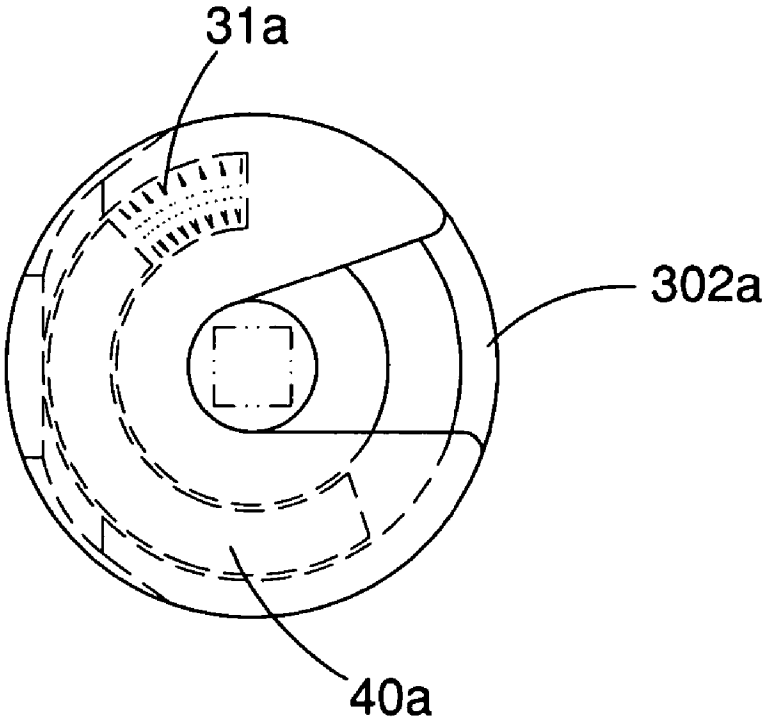
FIG. 12 is a schematic operational view as shown in FIG. 11.
Figure 11:
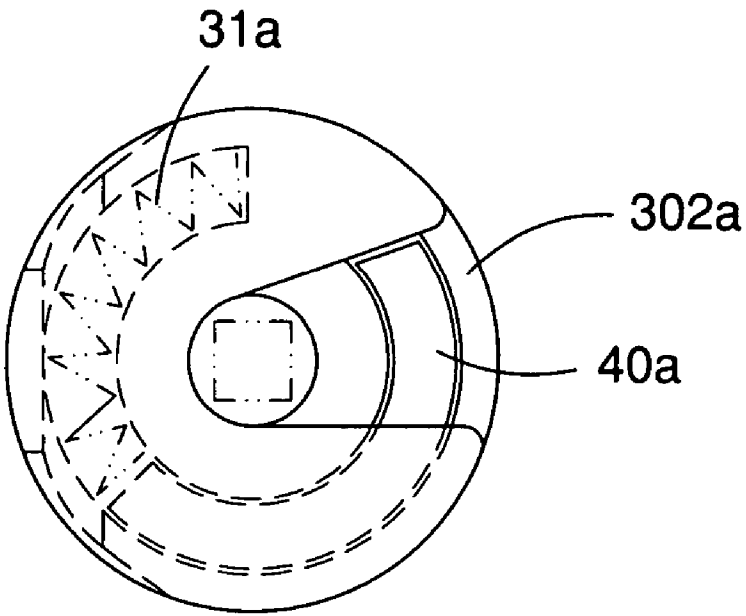
FIG. 11 is a top plan view as shown in FIG. 10.

Similar to the above embodiment, FIGS. 10-12 further show a structure of a limit knob 3*a*, a movable member 4*a* and a first locking mechanism 5*a*, as another preferred embodiment of the present invention. In this embodiment, the extension 40*a* of the movable member 4*a* is located opposite to and has a size greater than that of the extension 40 of the movable member 4, the knob body 30*a* of the limit knob 3*a* has a side opening 301*a* connected to the second opening 302*a* to allow passage of the extension 40*a* of the movable member 4*a*. Thus, when the movable member 4*a* is movable to the first position as shown in FIG. 11, the extension 40*a* of the movable member 4*a* blocks the second opening 302*a*, and when the movable member 4*a* is movable to the second position as shown in FIG. 12 by pushing of the movable shaft 51*a* of the first locking mechanism 5, the extension 40*a* of the movable member 4*a* is detached from the second opening 302*a* and presses the elastic member 31*a*. In addition, the extension 40*a* of the movable member 4*a* protrudes from the second opening 302*a* so as to protect the shackle.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

What is claimed is:

1. A padlock, comprising:

a housing;

a shackle movably mounted on the housing and having a root section extended into the housing and a free section having a first end extended from the root section and a second end extended outside of the housing;

a limit knob movably mounted on the housing to control movement of the free section of the shackle;

a movable member movably mounted in the limit knob; and a first locking mechanism mounted in the housing and comprising a key lock unit and a movable shaft mounted on the key lock unit wherein the key lock unit is configured to control movement of the limit knob and has a key hole to receive a matching key; and the movable shaft is driven to move the movable member when the key or an insert is inserted into the key hole of the key lock unit;

wherein the limit knob includes a knob body rotatably mounted on the housing and having an outer portion formed with a receiving recess to receive the free section of the shackle and an inner portion formed with a receiving chamber to receive the movable member, and a base portion extended from the knob body into the housing to connect the key lock unit, wherein the receiving recess has a central portion formed with a first opening and a peripheral wall formed with a second opening connected to the first opening.

2. The padlock in accordance with claim 1, wherein:

when the key or an insert is inserted into the key hole, the movable shaft is driven to move the movable member between a first position and a second position;

the movable member has an extension;

when the movable member is movable to the first position, the extension of the movable member blocks the second opening;

when the movable member is movable to the second position, the extension of the movable member is detached from the second opening.

3. The padlock in accordance with claim 1, wherein:

when the key or an insert is inserted into the key hole, the movable shaft is driven to move the movable member between a first position and a second position;

the movable member has an extension;

the limit knob has a peep hole;

when the movable member is movable to the first position, the extension of the movable member is exposed from the peep hole of the limit knob;

when the movable member is movable to the second position, the extension of the movable member is detached from the peep hole of the limit knob.

4. The padlock in accordance with claim 3, wherein:

the movable member has a side wall formed with a helical guide groove;

the movable shaft is partially extended into the movable member and provided with a guide rod movably mounted in the guide groove of the movable member;

when the movable shaft of the first locking mechanism is moved upward to a determined position, the guide rod of the movable shaft is lifted in the guide groove of the movable member to drive the movable member to rotate relative to the limit knob.

5. The padlock in accordance with claim 4, wherein the guide groove of the movable member has a top end formed with a positioning cavity to position the guide rod of the movable shaft.

6. The padlock in accordance with claim 5, wherein the limit knob further includes an elastic member biased between the knob body and the extension of the movable member, wherein when the guide rod of the movable shaft is positioned in the positioning cavity of the guide groove, the elastic member is pressed by the extension of the movable member.

7. The padlock in accordance with claim 6, wherein the key lock unit includes a mandrel having an inner portion formed with a through bore which has a first end to allow insertion of the key or an insert and a second end to receive the movable shaft, so that the movable shaft is directly driven by the key or an insert.

8. The padlock in accordance with claim 7, wherein a passage is defined between the mandrel and the limit knob to allow movement of the movable shaft and is connected to the receiving recess of the limit knob, so that the movable shaft is movable by pushing of the free section of the shackle.

9. The padlock in accordance with claim 8, wherein when the movable shaft is pushed by the free section of the shackle, the guide rod of the movable shaft is detached from the positioning cavity of the guide groove.

10. The padlock in accordance with claim 9, wherein the mandrel has one end formed with a control portion engaging the base portion of the limit knob.

11. The padlock in accordance with claim 10, wherein the control portion of the mandrel has an upper end formed with a square recess, and the base portion of the limit knob has a lower end formed with a square plug inserted into the square recess of the mandrel.

12. A padlock comprising:

a housing;

a shackle movably mounted on the housing and having a root section extended into the housing and a free section having a first end extended from the root section and a second end extended outside of the housing;

a limit knob comprising a knob body and a base portion extended from the knob body into the housing; the knob body being movably disposed on the outside of the housing to control movement of the free section of the shackle and defining a receiving recess therein to receive the free section of the shackle;

a movable member capable of moving on the limit knob; and a first locking mechanism comprising a key lock unit mounted in the housing and a movable shaft mounted on the key lock unit; the key lock unit being connected with the base portion to control movement of the knob body of the limit knob and having a key hole to receive a matching key; and the movable shaft being driven to move the movable member to an indicative position which is on the knob body of the limit knob when the key or an insert is inserted into the key hole of the key lock unit.

13. The padlock in accordance with claim 12, wherein the knob body of the limit knob further defines a receiving chamber therein to receive the movable member.

14. The padlock in accordance with claim 12, wherein the receiving recess of the knob body includes a first opening defined in a central portion of the knob body and a second opening defined in a peripheral wall of the knob body, and the first and second openings are in communication with each other.

15. The padlock in accordance with claim 12, further comprising a second locking mechanism disposed in the housing to control upward and downward movement of the root section of the shackle.

16. The padlock in accordance with claim 15, wherein the second locking mechanism includes a number lock module, wherein when the number lock module is disposed at an unlocked state, the root section of the shackle is released, and when the number lock module is disposed at a locked state, the root section of the shackle is locked.

* * * * *